US007094695B2

(12) United States Patent
Taylor

(10) Patent No.: US 7,094,695 B2
(45) Date of Patent: Aug. 22, 2006

(54) APPARATUS AND METHOD FOR CONDITIONING A POLISHING PAD USED FOR MECHANICAL AND/OR CHEMICAL-MECHANICAL PLANARIZATION

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 310 days.

(21) Appl. No.: 10/225,587

(22) Filed: Aug. 21, 2002

(65) Prior Publication Data

US 2004/0038534 A1 Feb. 26, 2004

(51) Int. Cl.
*H01L 21/302* (2006.01)

(52) U.S. Cl. ..... 438/691; 438/692; 438/693; 451/66

(58) Field of Classification Search ..... 438/691, 438/692, 693; 451/56, 72, 41, 412, 287, 451/443, 66, 136
See application file for complete search history.

(56) References Cited

U.S. PATENT DOCUMENTS 5,069,002 A 12/1991 Sandhu et al.
5,081,796 A 1/1992 Schultz
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,421,769 A 6/1995 Schultz et al.
5,433,651 A 7/1995 Lustig et al.
5,449,314 A 9/1995 Meikle et al.
5,486,129 A 1/1996 Sandhu et al.
5,514,245 A 5/1996 Doan et al.
5,533,924 A 7/1996 Stroupe et al.
5,540,810 A 7/1996 Sandhu et al.
5,616,069 A 4/1997 Walker et al.
5,618,381 A 4/1997 Doan et al.
5,626,509 A 5/1997 Hayashi
5,643,060 A 7/1997 Sandhu et al.
5,645,682 A 7/1997 Skrovan (Continued)

OTHER PUBLICATIONS

Seiichi Kondo, Noriyuki Sakuma, Yoshio Homma, Yasushi Goto, Naofumi Ohashi, Hizuru Yamaguchi, and Nobuo Owada, "Abrasive-Free Polishing for Copper Damascene Interconnection", *Journal of the Electrochemical Society*, 147 (10) pp. 3907-3913 (2000).

(Continued)

*Primary Examiner*—Lan Vinh
(74) *Attorney, Agent, or Firm*—Perkins Coie LLP

(57) ABSTRACT

Conditioning apparatuses and methods for conditioning polishing pads used for mechanical and/or chemical-mechanical planarization of micro-device workpieces are disclosed herein. In one embodiment, a method for conditioning a polishing pad used for polishing a micro-device workpiece includes monitoring surface condition in a first region of the polishing pad and adjusting at least one of a rotational velocity of the polishing pad, a downforce on the polishing pad, and a sweep velocity of the end effector in response to the monitored surface condition to provide a desired texture in the first region. In another embodiment, an apparatus for conditioning the polishing pad includes an end effector, a monitoring device, and a controller operatively coupled to the end effector and the monitoring device. The controller has a computer-readable medium containing instructions to perform a conditioning method, such as the above-mentioned method.

53 Claims, 3 Drawing Sheets

U.S. PATENT DOCUMENTS 5,655,951 A 8/1997 Meikle et al.
5,658,183 A 8/1997 Sandhu et al.
5,658,190 A 8/1997 Wright et al.
5,664,988 A 9/1997 Stroupe et al.
5,679,065 A 10/1997 Henderson
5,702,292 A 12/1997 Brunelli et al.
5,725,417 A 3/1998 Robinson
5,730,642 A 3/1998 Sandhu et al.
5,747,386 A 5/1998 Moore
5,779,522 A 7/1998 Walker et al.
5,782,675 A 7/1998 Southwick
5,792,709 A 8/1998 Robinson et al.
5,795,495 A 8/1998 Meikle
5,801,066 A 9/1998 Meikle
5,807,165 A 9/1998 Uzoh et al.
5,830,806 A 11/1998 Hudson et al.
5,833,519 A 11/1998 Moore
5,846,336 A 12/1998 Skrovan
5,851,135 A 12/1998 Sandhu et al.
5,868,896 A 2/1999 Robinson et al.
5,879,226 A 3/1999 Robinson
5,882,248 A 3/1999 Wright et al.
5,893,754 A 4/1999 Robinson et al.
5,895,550 A 4/1999 Andreas
5,904,615 A 5/1999 Jeong et al.
5,910,043 A 6/1999 Manzonie et al.
5,930,699 A 7/1999 Bhatia
5,934,980 A 8/1999 Koos et al.
5,941,761 A * 8/1999 Nagahara et al. ..... 451/56
5,945,347 A 8/1999 Wright
5,954,912 A 9/1999 Moore
5,967,030 A 10/1999 Blalock
5,972,792 A 10/1999 Hudson
5,975,994 A 11/1999 Sandhu
5,980,363 A 11/1999 Meikle et al.
5,981,396 A 11/1999 Robinson et al.
5,994,224 A 11/1999 Sandhu et al.
5,997,384 A 12/1999 Blalock
6,004,196 A 12/1999 Doan et al.
6,039,633 A 3/2000 Chopra
6,040,245 A 3/2000 Sandhu et al.
6,054,015 A 4/2000 Brunelli et al.
6,066,030 A 5/2000 Uzoh
6,074,286 A 6/2000 Ball
6,083,085 A 7/2000 Lankford
6,106,371 A * 8/2000 Nagahara et al. ..... 451/56
6,110,820 A 8/2000 Sandhu et al.
6,116,988 A 9/2000 Ball
6,120,354 A 9/2000 Koos et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,180,525 B1 1/2001 Morgan
6,187,681 B1 2/2001 Moore
6,191,037 B1 2/2001 Robinson et al.
6,193,588 B1 2/2001 Carlson
6,196,899 B1 3/2001 Chopra et al.
6,200,901 B1 3/2001 Hudson et al.
6,203,404 B1 3/2001 Joslyn et al.
6,203,413 B1 3/2001 Skrovan
6,206,756 B1 3/2001 Chopra et al.
6,210,257 B1 4/2001 Carlson
6,213,845 B1 4/2001 Elledge
6,214,734 B1 * 4/2001 Bothra et al. ..... 438/692
6,218,316 B1 4/2001 Marsh
6,220,934 B1 4/2001 Sharples et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,238,270 B1 5/2001 Robinson
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,273,800 B1 8/2001 Walker et al.
6,276,996 B1 8/2001 Chopra
6,284,660 B1 9/2001 Doan
6,306,008 B1 10/2001 Moore
6,306,012 B1 10/2001 Sabde
6,306,014 B1 10/2001 Walker et al.
6,306,768 B1 10/2001 Klein
6,312,558 B1 11/2001 Moore
6,328,632 B1 12/2001 Chopra
6,331,139 B1 12/2001 Walker et al.
6,331,488 B1 12/2001 Doan et al.
6,350,180 B1 2/2002 Southwick
6,350,691 B1 2/2002 Lankford
6,352,466 B1 3/2002 Moore
6,352,470 B1 3/2002 Elledge
6,354,918 B1 3/2002 Togawa et al.
6,354,923 B1 3/2002 Lankford
6,354,930 B1 3/2002 Moore
6,358,122 B1 3/2002 Sabde et al.
6,358,127 B1 3/2002 Carlson et al.
6,358,129 B1 3/2002 Dow
6,361,411 B1 3/2002 Chopra et al.
6,361,413 B1 3/2002 Skrovan
6,361,417 B1 3/2002 Walker et al.
6,364,757 B1 4/2002 Moore
6,368,190 B1 4/2002 Easter et al.
6,368,193 B1 4/2002 Carlson et al.
6,368,194 B1 4/2002 Sharples et al.
6,368,197 B1 4/2002 Elledge
6,376,381 B1 4/2002 Sabde
6,383,934 B1 5/2002 Sabde et al.
6,387,289 B1 5/2002 Wright
6,395,620 B1 5/2002 Pan et al.
6,402,884 B1 6/2002 Robinson et al.
6,419,553 B1 * 7/2002 Koinkar et al. ..... 451/21
6,428,386 B1 8/2002 Bartlett
6,447,369 B1 9/2002 Moore
6,498,101 B1 12/2002 Wang
6,511,576 B1 1/2003 Klein
6,520,834 B1 2/2003 Marshall
6,533,893 B1 3/2003 Sabde et al.
6,547,640 B1 4/2003 Hofmann
6,548,407 B1 4/2003 Chopra et al.
6,579,799 B1 6/2003 Chopra et al.
6,592,443 B1 7/2003 Kramer et al.
6,609,947 B1 8/2003 Moore
6,609,962 B1 8/2003 Wakabayashi et al.
6,648,728 B1 11/2003 Kojima et al.
6,652,764 B1 11/2003 Blalock
6,666,749 B1 12/2003 Taylor
6,695,680 B1 2/2004 Choi et al.
6,769,972 B1 8/2004 Huang et al.
6,893,336 B1 5/2005 Jin

OTHER PUBLICATIONS

U.S. Appl. No. 10/910,690, filed Aug. 2, 2004, Mayes et al.

* cited by examiner

APPARATUS AND METHOD FOR CONDITIONING A POLISHING PAD USED FOR MECHANICAL AND/OR CHEMICAL-MECHANICAL PLANARIZATION

TECHNICAL FIELD

The present invention relates to an apparatus and method for conditioning a polishing pad used for mechanical and/or chemical-mechanical planarization of micro-device workpieces.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow 1).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the micro-device workpiece 12 with the CMP machine 10, the carrier head 30 presses the workpiece 12 face-down against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the micro-device workpiece 12 to enable precise fabrication of circuits and photo-patterns. One problem with conventional CMP methods is that the planarizing surface 42 of the planarizing pad 40 can wear unevenly or become glazed with accumulations of planarizing solution 44 and/or material removed from the micro-device workpiece 12 and/or planarizing pad 40. To restore the planarizing characteristics of the planarizing pad 40, the pad 40 is typically conditioned by removing the accumulations of waste matter with an abrasive conditioning disk 50. The conventional abrasive conditioning disk 50 is generally embedded with diamond particles and mounted to a separate actuator 55 that moves the conditioning disk 50 rotationally, laterally, and/or axially, as indicated by arrows A, B, and C, respectively. The typical conditioning disk 50 removes a thin layer of the planarizing pad material in addition to the waste matter to form a new, clean planarizing surface 42 on the planarizing pad 40.

During the conditioning process, the conditioning disk 50 imparts texture to the planarizing pad 40. One problem with conventional conditioning methods is that even if the conditioning disk 50 uniformly removes the planarizing pad material, different textures are formed across the planarizing pad 40. Differences in texture across the planarizing pad 40 can cause the pad 40 to remove material at different rates across the micro-device workpiece 12 during the CMP process. Differences in texture can also produce defects on the micro-device workpiece 12. Consequently, the CMP process may not produce a uniformly planar surface on the micro-device workpiece 12.

SUMMARY

The present invention is directed toward conditioning apparatuses and methods for conditioning polishing pads used for mechanical and/or chemical-mechanical planarization of micro-device workpieces. In one embodiment, a method for conditioning a polishing pad includes determining surface condition in a first region of the polishing pad, determining surface condition in a second region of the polishing pad, and adjusting at least one of a relative velocity between the polishing pad and an end effector, an existing downforce on the polishing pad, and a sweep velocity of the end effector in response to the determined surface condition of the first region to provide a desired first surface texture in the first region. The method further includes adjusting at least one of the relative velocity between the polishing pad and the end effector, the existing downforce on the polishing pad, and the sweep velocity of the end effector in response to the determined surface condition of the second region to provide a desired second surface texture in the second region. In a further aspect of this embodiment, determining surface condition can include sensing surface texture, roughness, and/or asperities. In another aspect of this embodiment, determining surface condition can occur while the polishing pad is in-situ, rotating, and/or stationary.

In another embodiment of the invention, a method for conditioning the polishing pad includes monitoring surface condition in the first region of the polishing pad and adjusting at least one of a rotational velocity of the polishing pad, the downforce on the polishing pad, and the sweep velocity of the end effector in response to the monitored surface condition to provide the desired texture in the first region.

In another embodiment of the invention, an apparatus for conditioning the polishing pad includes an end effector, a monitoring device, and a controller operatively coupled to the end effector and the monitoring device. In one aspect of this embodiment, the controller has a computer-readable medium containing instructions to perform a method including determining surface condition in the first region of the polishing pad, determining surface condition in the second region of the polishing pad, and adjusting at least one of the relative velocity between the polishing pad and the end effector, the existing downforce on the polishing pad, and the sweep velocity of the end effector in response to the determined surface condition of the first region to provide the desired first surface texture in the first region. The method further includes adjusting at least one of the relative velocity between the polishing pad and the end effector, the existing downforce on the polishing pad, and the sweep velocity of the end effector in response to the determined surface condition of the second region to provide a desired second surface texture in the second region.

In another aspect of this embodiment, the controller has a computer-readable medium containing instructions to perform a method including monitoring surface condition in the first region of the polishing pad, and adjusting at least one of the rotational velocity of the polishing pad, the downforce on the polishing pad, and the sweep velocity of the end effector in response to the monitored surface condition to provide the desired texture in the first region.

DETAILED DESCRIPTION

The present invention is directed to apparatuses and methods for conditioning polishing pads used for mechanical and/or chemical-mechanical planarization of micro-device workpieces. The term "micro-device workpiece" is used throughout to include substrates in and/or on which micro-electronic devices, micro-mechanical devices, data storage elements, and other features are fabricated. For example, micro-device workpieces can be semi-conductor wafers, glass substrates, insulated substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–4 to provide a thorough understanding of certain embodiments of the invention. One skilled in the art, however, will understand that the present invention may have additional embodiments, or that other embodiments of the invention may be practiced without several of the specific features explained in the following description.

Figure 1:
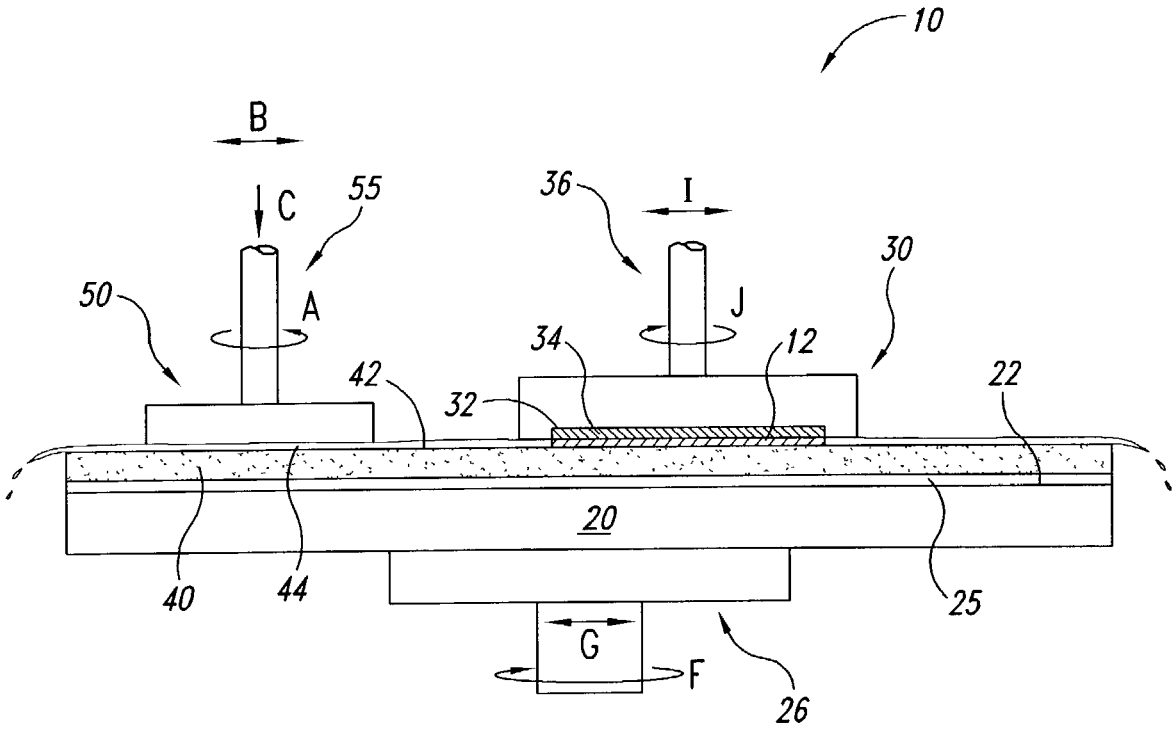
Fig. 1 (Prior Art)
FIG. 1 is a schematic cross-sectional view of a portion of a rotary planarizing machine and an abrasive conditioning disk in accordance with the prior art.
Figure 2:
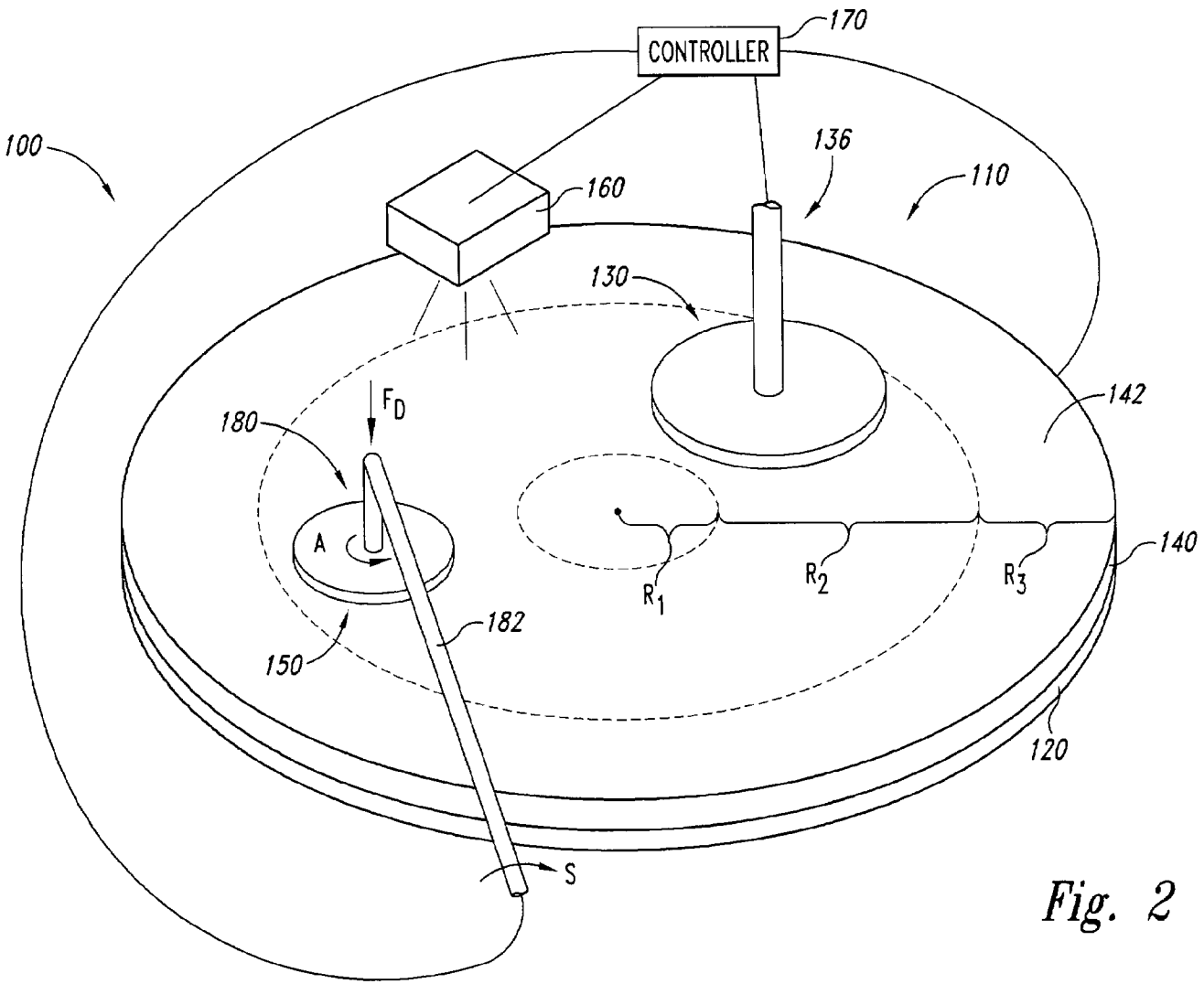
FIG. 2 is a schematic isometric view of a portion of a rotary planarizing machine and a conditioning system in accordance with one embodiment of the invention.

FIG. 2 is a schematic isometric view of a conditioning system 100 in accordance with one embodiment of the invention. The conditioning system 100 can be coupled to a CMP machine 110 to refurbish a planarizing pad 140 or to bring a planarizing surface 142 of the planarizing pad 140 to a desired state for consistent planarizing. The CMP machine 110 can be similar to the CMP machine 10 discussed above. For example, the CMP machine 110 can include a carrier head 130 coupled to an actuator assembly 136 to move the workpiece (not shown) across the planarizing surface 142 of the planarizing pad 140.

In the illustrated embodiment, the conditioning system 100 includes a monitoring device 160, a controller 170, and an end effector 180. The end effector 180 can include an arm 182 and a conditioning disk 150 coupled to the arm 182 to exert a downforce $F_D$ against the planarizing pad 140. The conditioning disk 150 is generally imbedded with diamond particles to remove waste matter and a thin layer of the planarizing pad 140. The conditioning disk 150 forms a new clean planarizing surface 142 on the planarizing pad 140. The conditioning disk 150 rotates (indicated by arrow A) with a rotational velocity $\omega_1$ to abrade the planarizing pad 140 with the diamond particles. In the illustrated embodiment, the arm 182 can sweep the conditioning disk 150 across the planarizing surface 142 in a direction S with a sweep velocity $S_V$. The sweep velocity $S_V$ can change as the conditioning disk 150 moves across the planarizing surface 142 so that the disk 150 contacts different areas on the planarizing surface 142 for different dwell times. In the illustrated embodiment, the conditioning disk 150 conditions the planarizing pad 140 in-situ and in real-time with the planarization process. In other embodiments, conditioning and planarization may not occur concurrently.

The monitoring device 160 monitors the surface condition of the planarizing surface 142. For example, the monitoring device 160 can determine the surface texture, roughness, and/or asperities of the planarizing surface 142. The monitoring device 160 can be stationary or movable relative to the CMP machine 110 to monitor the entire planarizing surface 142 of the planarizing pad 140 when the pad 140 is stationary or while it rotates. In one embodiment, the monitoring device 160 can include an optical analyzer, such as an interferometer or a device that measures the scatter of light. In other embodiments, the monitoring device 160 can use contact methods, such as frictional forces, or profilometry to monitor the surface condition. In any of these embodiments, the monitoring device 160 can monitor a single region or a plurality of monitoring devices can monitor multiple regions on the planarizing pad 140 concurrently. For example, the planarizing surface 142 of the planarizing pad 140 can be analyzed by organizing the pad 140 into known regions, such as a first region $R_1$, a second region $R_2$, and a third region $R_3$. The monitoring device 160 can monitor the surface condition in the first, second, and third regions $R_1$, $R_2$, and $R_3$ simultaneously. In other embodiments, the monitoring device 160 may monitor only one region at a time. In still other embodiments, a single monitoring device could be movable to monitor more than one region.

The controller 170 is operatively coupled to a platen 120, the actuator assembly 136, the monitoring device 160, and the end effector 180 to control the conditioning process. The controller 170 controls the conditioning process by adjusting certain process variables to provide a desired surface texture across the planarizing pad 140. For example, the controller 170 can adjust the relative velocity between the planarizing pad 140 and the end effector 180, the downforce $F_D$ of the end effector 180 on the planarizing pad 140, and/or the sweep velocity $S_V$ of the end effector 180 to provide the desired texture on the planarizing surface 142. The controller 170 can adjust the relative velocity between the planarizing pad 140 and the end effector 180 by changing the speed at which the platen 120 rotates. Accordingly, the controller 170 regulates the conditioning process to provide a desired surface condition. In one embodiment, the controller 170 can include a computer; in other embodiments, the controller 170 can include a hardwired circuit board.

Figure 3:
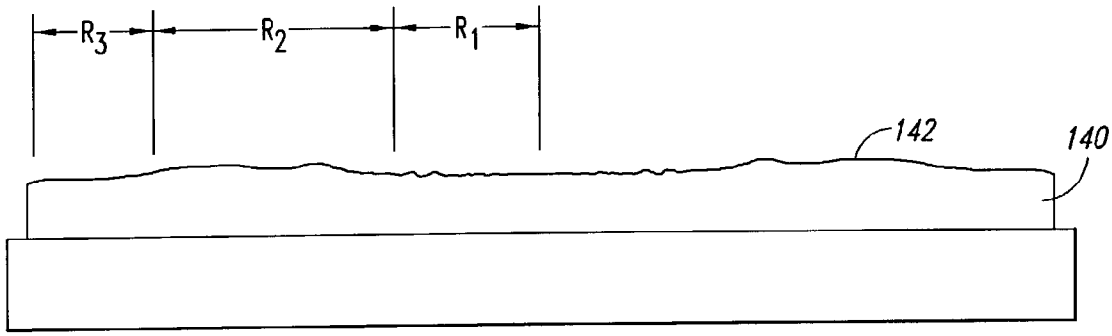
FIG. 3 is a side schematic view of the planarizing pad before conditioning.

FIG. 3 is a side schematic view of the planarizing pad 140 having a nonuniform surface texture before conditioning. During planarization, the micro-device workpiece can wear down some or all of the planarizing pad 140. Furthermore, the planarizing pad 140 can become glazed with accumulations of planarizing solution and/or material removed from the micro-device workpiece and/or planarizing pad 140. The waste matter is especially problematic in applications that planarize borophosphate silicon glass or other relatively soft materials. In the illustrated embodiment, the second region $R_2$, which does most of the planarizing, has a glazed surface. The first region $R_1$, which does a fair amount of the planarizing per unit area, and the third region $R_3$, which does very little planarizing per unit area, both have worn surfaces. The planarizing pad 140 must accordingly be conditioned to return the planarizing surface 142 to a state that is acceptable for planarizing additional micro-device workpieces. Referring to FIGS. 2 and 3, to provide a uniform surface texture across the planarizing pad 140, for example, in the second region $R_2$ (relative to the first and third regions $R_1$ and $R_3$) at least one of the conditioning variables would need to change as follows: exert a greater downforce $F_D$ by the end effector 180; increase rotational speed of the platen 120; and/or decrease the sweep velocity $S_V$ of the arm 182.

Referring to FIG. 2, in operation, the monitoring device 160 monitors the planarizing surface 142 to detect differences in surface conditions, such as the surface texture, roughness, and/or asperities across the planarizing pad 140. If the monitoring device 160 detects, for example, a first texture $T_1$ in the first region $R_1$ and a second texture $T_2$ in the second region $R_2$, the controller 170 will adjust one or more conditioning variables in response to the signals received from the monitoring device 160 to provide a desired texture in the first region $R_1$ and/or the second region $R_2$. More specifically, the controller 170 will adjust the relative velocity between the planarizing pad 140 and the end effector 180, the downforce $F_D$ of the end effector 180, and/or the sweep velocity $S_V$ of the end effector 180 to provide a desired texture on the planarizing surface 142. The monitoring device 160 monitors the planarizing surface 142 throughout the conditioning process to detect differences in surface conditions, and the controller 170 adjusts at least one of the above-mentioned conditioning variables in response to the signals received from the monitoring device 160 to provide a desired texture on the planarizing pad 140.

In one embodiment, for example, the controller 170 can vary the dwell time $D_t$ of the conditioning disk 150 and the platen's rotational velocity $\Omega$ to maintain a constant relative velocity $V_r$ between the planarizing pad 140 and the conditioning disk 150 to provide a uniform surface texture across the pad 140. If the required relative velocity $V_r$ is known, the platen's rotational velocity $\Omega_R$ at a radius R can be determined by the following formula:

$$\Omega_R = \frac{V_r}{2\pi R}$$

The dwell time $D_{t(R)}$ of the conditioning disk 150 at the radius R can be determined by the following formula:

$$D_{t(R)} = \frac{(C_1 \pi R)}{r_c V_r}$$

where $C_l$ is the length of conditioning and $r_c$ is the radius of the conditioning disk 150, assuming the required length of conditioning $C_l$ is known. In other embodiments, the downforce $F_D$ can be adjusted, such as when the conditioning disk 150 conditions the edge of the planarizing pad 140 and a portion of the disk 150 hangs over the pad 140.

Figure 4:
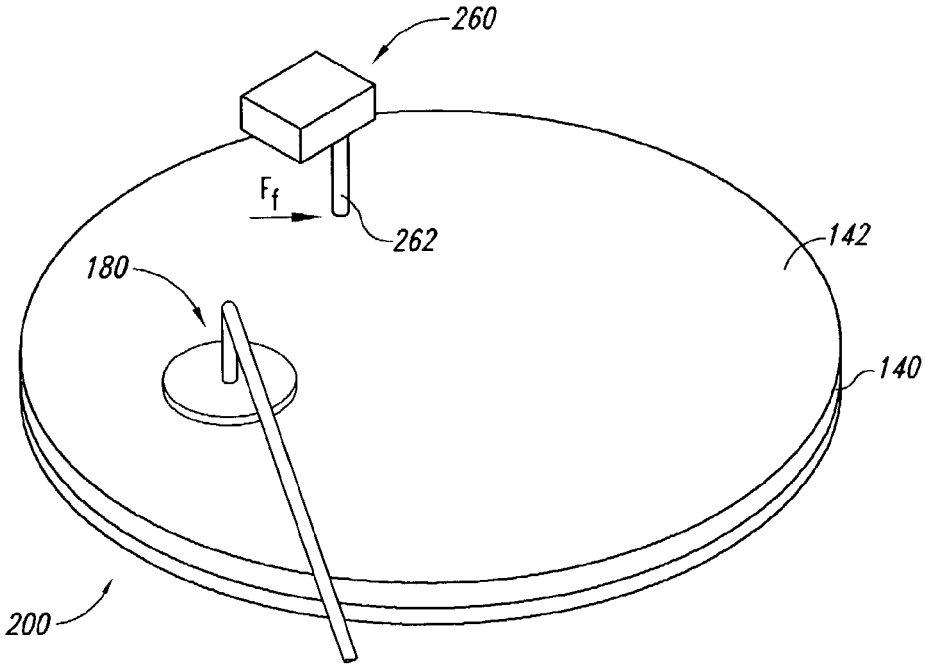
FIG. 4 is a schematic view of a conditioning system with a monitoring device in accordance with another embodiment of the invention.

FIG. 4 is a schematic view of a conditioning system 200 having a different monitoring device 260 in accordance with another embodiment of the invention. In the illustrated embodiment, the conditioning system 200 also includes the controller 170 and the end effector 180 described above. The monitoring device 260 includes an arm 262 extending downwardly toward the planarizing pad 140. When the arm 262 contacts the planarizing pad 140 and the arm 262 and/or the planarizing pad 140 move relative to each other, a frictional force $F_f$ is generated. The monitoring device 260 measures the frictional force $F_f$ between the arm 262 and the planarizing pad 140 to determine the surface condition of the planarizing surface 142. The frictional force $F_f$ generally increases as the roughness of the planarizing pad 140 increases. In one embodiment, the monitoring device 260 can include a load cell that measures the frictional force $F_f$. In other embodiments, strain gauges, pressure transducers, and other devices can be used to measure the frictional force $F_f$. Suitable systems with strain gauges and pressure transducers for determining the drag force are disclosed in U.S. Pat. No. 6,306,008, which is herein incorporated by reference. In additional embodiments, the monitoring device 260 can be an integral portion of the end effector 180, measuring the frictional force $F_f$ exerted on the end effector 180 by the planarizing pad 140.

One advantage of the conditioning systems in the illustrated embodiments is the ability to control both the surface texture and the surface contour in real-time throughout the conditioning cycle. For example, the conditioning systems can provide a first desired surface texture in a first region of the planarizing pad and a second desired surface texture in a second region of the pad. The conditioning systems can also provide a uniform surface texture across the planarizing pad so that material can be removed from a micro-device workpiece uniformly across the workpiece during the CMP process. A uniform surface texture can also reduce defects on the micro-device workpiece.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A method for conditioning a polishing pad used for polishing a micro-device workpiece, comprising:

determining surface condition in a first region of the polishing pad;

determining surface condition in a second region of the polishing pad;

adjusting at least one of a relative velocity between the polishing pad and an end effector, an existing downforce on the polishing pad, and a sweep velocity of the end effector in response to the determined surface condition of the first region to provide a desired first surface texture in the first region; and adjusting at least one of the relative velocity between the polishing pad and the end effector, the existing downforce on the polishing pad, and the sweep velocity of the end effector in response to the determined surface condition of the second region to provide a desired second surface texture in the second region.

2. The method of claim 1 wherein determining surface condition in a first region comprises sensing surface texture in the first region, and wherein determining surface condition in a second region comprises sensing surface texture in the second region.

3. The method of claim 1 wherein determining surface condition in a first region comprises sensing surface roughness in the first region, and wherein determining surface condition in a second region comprises sensing surface roughness in the second region.

4. The method of claim 1 wherein determining surface condition in a first region comprises sensing surface asperities in the first region, and wherein determining surface condition in a second region comprises sensing surface asperities in the second region.

5. The method of claim 1, further comprising rotating the polishing pad, wherein determining surface condition in a first region and determining surface condition in a second region occur while rotating the polishing pad.

6. The method of claim 1 wherein determining surface condition in a first region and determining surface condition in a second region occur while the polishing pad is stationary.

7. The method of claim 1, further comprising engaging the end effector with the polishing pad, wherein determining surface condition in a first region and determining surface condition in a second region occur continuously while engaging the end effector.

8. The method of claim 1, further comprising engaging the end effector with the polishing pad, wherein determining surface condition in a first region and determining surface condition in a second region occur intermittently while engaging the end effector.

9. The method of claim 1 wherein determining surface condition in a first region and determining surface condition in a second region occur concurrently.

10. The method of claim 1 wherein determining surface condition in a first region occurs before determining surface condition in a second region.

11. The method of claim 1 wherein determining surface condition in a first region and determining surface condition in a second region comprise measuring a frictional force in a plane defined by the polishing pad.

12. The method of claim 1 wherein determining surface condition in a first region and determining surface condition in a second region comprise optically analyzing the polishing pad.

13. The method of claim 1 wherein the desired first surface texture and the desired second surface texture are different.

14. A method for conditioning a polishing pad used for polishing a micro-device workpiece, comprising:

monitoring surface condition in a first region of the polishing pad with a monitoring device; and adjusting at least one of a rotational velocity of the polishing pad, a downforce on the polishing pad, and a sweep velocity of an end effector in response to the monitored surface condition to provide a desired texture in the first region.

15. The method of claim 14 wherein monitoring surface condition in a first region comprises sensing surface texture in the first region.

16. The method of claim 14 wherein monitoring surface condition in a first region comprises sensing surface roughness in the first region.

17. The method of claim 14 wherein monitoring surface condition in a first region comprises sensing surface asperities in the first region.

18. The method of claim 14, further comprising rotating the polishing pad, wherein monitoring surface condition in a first region occurs while rotating the polishing pad.

19. The method of claim 14 wherein monitoring surface condition in a first region occurs while the polishing pad is stationary.

20. The method of claim 14, further comprising engaging the end effector with the polishing pad, wherein monitoring surface condition in a first region occurs continuously while engaging the end effector.

21. The method of claim 14, further comprising engaging the end effector with the polishing pad, wherein monitoring surface condition in a first region occurs intermittently while engaging the end effector.

22. The method of claim 14 wherein monitoring surface condition in a first region comprises measuring a frictional force in a plane defined by the polishing pad.

23. The method of claim 14 wherein monitoring surface condition in a first region comprises optically analyzing the first region of the polishing pad.

24. The method of claim 14, further comprising monitoring surface condition in a second region of the polishing pad.

25. The method of claim 14 wherein the desired texture is a desired first texture, and wherein the method further comprises:

monitoring surface condition in a second region of the polishing pad; and adjusting at least one of the rotational velocity of the polishing pad, the downforce on the polishing pad, and the sweep velocity of the end effector to provide a desired second texture in the second region.

26. The method of claim 14, further comprising monitoring surface condition in a second region of the polishing pad, wherein monitoring surface condition in the second region occurs concurrently with monitoring surface condition in the first region.

27. A method for conditioning a polishing pad used for polishing a micro-device workpiece, comprising:

determining roughness of surface texture in a first region of the polishing pad; and controlling at least one of a relative velocity between the polishing pad and an end effector, a downforce on the polishing pad, and a sweep velocity of an end effector in response to the determined roughness of surface texture to provide a desired texture in the first region.

28. The method of claim 27 wherein determining roughness of surface texture in a first region comprises detecting surface asperities in the first region.

29. The method of claim 27 wherein determining roughness of surface texture in a first region comprises measuring a frictional force in a plane defined by the polishing pad.

30. The method of claim 27 wherein determining roughness of surface texture in a first region comprises optically analyzing the first region of the polishing pad.

31. The method of claim 27 wherein the desired texture is a desired first texture, and the method further comprises:

determining roughness of surface texture in a second region of the polishing pad; and controlling at least one of the relative velocity between the polishing pad and the end effector, the downforce on the polishing pad, and the sweep velocity of the end effector in response to the determined roughness to provide a desired second texture in the second region.

32. A method for conditioning a polishing pad used for polishing a micro-device workpiece, comprising:

analyzing surface texture in a first region of the polishing pad;

analyzing surface texture in a second region of the polishing pad;

controlling at least one of a rotational velocity of the polishing pad, an existing downforce on the polishing pad, and a sweep velocity of an end effector in response to the analyzed surface texture of the first region to provide a desired first surface texture in the first region; and controlling at least one of the rotational velocity of the polishing pad, the existing downforce on the polishing pad, and the sweep velocity of the end effector in response to the analyzed surface texture of the second region to provide a desired second surface texture in the second region.

33. The method of claim 32 wherein analyzing surface texture in a first region comprises sensing surface texture in the first region, and wherein analyzing surface texture in a second region comprises sensing surface texture in the second region.

34. The method of claim 32 wherein analyzing surface texture in a first region comprises sensing surface roughness in the first region, and wherein analyzing surface texture in a second region comprises sensing surface roughness in the second region.

35. The method of claim 32 wherein analyzing surface texture in a first region comprises sensing surface asperities in the first region, and wherein analyzing surface texture in a second region comprises sensing surface asperities in the second region.

36. The method of claim 32 wherein analyzing surface texture in a first region comprises measuring a frictional force in the first region in a plane defined by the polishing pad, and wherein analyzing surface texture in a second region comprises measuring the frictional force in the second region in the plane defined by the polishing pad.

37. The method of claim 32 wherein analyzing surface texture in a first region comprises optically analyzing the first region of the polishing pad, and wherein analyzing surface texture in a second region comprises optically analyzing the second region.

38. The method of claim 32 wherein the desired first texture is different from the desired second texture.

39. A method for conditioning a polishing pad used for polishing a micro-device workpiece, comprising:

engaging an end effector with the polishing pad and moving at least one of the end effector and the polishing pad relative to the other;

monitoring surface condition in a first region of the polishing pad; and providing a desired texture in the first region of the polishing pad by regulating at least one of a relative velocity between the polishing pad and the end effector, a downforce on the polishing pad, and a sweep velocity of the end effector in response to the monitored surface condition of the first region.

40. The method of claim 39 wherein monitoring surface condition in a first region comprises sensing surface texture in the first region.

41. The method of claim 39 wherein monitoring surface condition in a first region comprises sensing surface roughness in the first region.

42. The method of claim 39 wherein monitoring surface condition in a first region comprises sensing surface asperities in the first region.

43. The method of claim 39 wherein monitoring surface condition in a first region occurs continuously while engaging the end effector.

44. The method of claim 39 wherein monitoring surface condition in a first region occurs intermittently while engaging the end effector.

45. The method of claim 39 wherein monitoring surface condition in a first region comprises measuring a frictional force in a plane defined by the polishing pad.

46. The method of claim 39 wherein monitoring surface condition in a first region comprises optically analyzing the first region.

47. The method of claim 39, further comprising monitoring surface condition in a second region of the polishing pad.

48. The method of claim 39 wherein a desired texture is a desired first texture, and wherein the method further comprises:

monitoring surface condition in a second region of the polishing pad; and providing a desired second texture in the second region of the polishing pad by regulating at least one of the relative velocity between the polishing pad and the end effector, the downforce on the polishing pad, and the sweep velocity of the end effector in response to the monitored surface condition of the second region.

49. The method of claim 39, further comprising monitoring surface condition in a second region of the polishing pad, wherein monitoring surface condition in the second region occurs concurrently with monitoring surface condition in the first region.

50. A method for conditioning a polishing pad used for polishing a micro-device workpiece, comprising:

engaging an end effector with the polishing pad and moving at least one of the end effector and the polishing pad relative to the other;

determining roughness of surface texture in a first region of the polishing pad; and providing a desired texture in the first region of the polishing pad by adjusting at least one of a rotational velocity of the polishing pad, a downforce on the polishing pad, and a sweep velocity of the end effector in response to the determined roughness of surface texture.

51. The method of claim 50 wherein determining roughness of surface texture in a first region comprises detecting surface asperities in the first region.

52. The method of claim 50 wherein determining roughness of surface texture in a first region comprises measuring a frictional force in a plane defined by the polishing pad.

53. The method of claim 50 wherein determining roughness of surface texture in a first region comprises optically analyzing the first region.

* * * * *